US005937802A

United States Patent [19]

Bethel et al.

[11] Patent Number: 5,937,802

[45] Date of Patent: Aug. 17, 1999

[54] ENGINE COOLING SYSTEM

[75] Inventors: Steven J. Bethel, Oakfield; Mark A. Ruman, Fond du Lac; Donald R. Kellermann, Oshkosh; Robert J. Baumhardt, Campbellsport, all of Wis.

[73] Assignee: Brunswick Corporation, Lake Forest, Ill.

[21] Appl. No.: 08/947,062

[22] Filed: Oct. 8, 1997

[51] Int. Cl.[6] ..... F01P 3/02

[52] U.S. Cl. ..... 123/41.74; 123/41.08; 123/41.72; 440/88; 440/DIG. 300

[58] Field of Search ..... 123/41.08, 41.72, 123/41.74; 440/88, DIG. 900

[56] References Cited

U.S. PATENT DOCUMENTS

| | | | |
|---|---|---|---|
| 3,319,614 | 5/1967 | Shanahan | 123/41.08 |
| 3,358,654 | 12/1967 | Shanahan et al. | 123/41.08 |
| 3,908,579 | 9/1975 | Miller | 115/17 |
| 4,082,068 | 4/1978 | Hale | 123/41.02 |
| 4,312,304 | 1/1982 | Tyner | 123/41.74 |
| 4,357,912 | 11/1982 | Brown | 123/41.08 |
| 4,457,727 | 7/1984 | Flaig | 440/88 |
| 4,559,908 | 12/1985 | Flaig | 123/41.98 |
| 4,674,449 | 6/1987 | Hundertmark | 123/41.08 |
| 5,048,467 | 9/1991 | Kojima | 123/47.74 |
| 5,193,499 | 3/1993 | Binversie | 123/195 |
| 5,295,881 | 3/1994 | Breckenseld | 440/89 |
| 5,715,777 | 2/1998 | Wada et al. | 123/41.09 |
| 5,769,038 | 6/1998 | Takahashi et al. | 123/41.82 R |

*Primary Examiner*—Henry C. Yuen
*Assistant Examiner*—Hai Huynh
*Attorney, Agent, or Firm*—William D. Lanyi

[57] ABSTRACT

A cooling system for an internal combustion engine is provided with coolant paths through the cylinder block and cylinder head which are connected in serial fluid communication with each other. In parallel with the cooling path through the cylinder head, a first drain is connected in serial fluid communication with a pressure responsive valve and the path through the cylinder block. A temperature responsive valve 64 is connected in serial fluid communication with the cylinder head path and in parallel fluid communication with the first drain. A pump is provided to induce fluid flow through the first and second coolant conduits and the first and second drains, depending on the space of the pressure responsive valve and the temperature responsive valve.

20 Claims, 8 Drawing Sheets

ENGINE COOLING SYSTEM

BACKGROUND OF THE INVENTION

1. Field of the Invention

The present invention is generally related to an engine cooling system and, more particularly, to a cooling system that provides a means for increasing the cooling of the engine block even when the cylinder head has not reached normal operating temperature.

2. Description of the Prior Art

Many types of engines, including internal combustion engines, are well known to those skilled in the art. Since the combustion process produces heat, some means must be provided to remove the heat from the areas of the engine block in which it could possibly cause distortion and damage. It is well known to provide cooling passages formed within the engine block. These cooling passages serve as conduits for the coolant, which is typically water. In marine applications, such as outboard motors, the coolant water is typically drawn from the body of water on which the outboard motor is being used and, after passing through the coolant path within the engine block, the water is discharged back into that body of water.

U.S. Pat. No. 5,295,881, which issued to Breckenseld et al on Mar. 22, 1994, discloses a marine propulsion device with coolant water passages. The device comprises an internal combustion engine including an engine block having therein a water jacket and having a lower face which includes therein a recess, a driveshaft housing connected to the lower face of the engine block, a propeller shaft rotatably supported by the drive shaft housing and adapted to support a propeller, a driveshaft extending through the driveshaft housing and including an upper end driven by the engine and a lower end drivingly connected to the propeller shaft, an exhaust housing located at least partially within the driveshaft housing and including an upper face mating with the lower face of the engine block and including therein a recess located in opposed relation to the recess in the lower face, a water passage defined by the recess in the lower face of the engine block and by the recess in the upper face of the exhaust housing, which has an inlet end and an outlet end spaced horizontally from the inlet end and communicating with the water jacket. It also comprises a conduit connected to the inlet end for supplying water to the inlet end.

U.S. Pat. No. 5,193,499, which issued to Binversie et al on Mar. 16, 1993, describes a cast inter-cylinder cooling passage for an internal combustion engine. The motor block for a multiple cylinder internal combustion engine, particularly an outboard motor, has a cooling passage that is integrally cast as a part of the motor block casting and extends from a water jacket in the cylinder head area to a water jacket space that is provided between the banks of cylinders in the v-block engine.

U.S. Pat. No. 4,559,908, which issued to Flaig et al on Dec. 24, 1985, describes a method for fabricating an integrally cast engine block including a plurality of cylinders, exhaust passage portions which respectively extend from the cylinders and which form portions of exhaust gas passages of equal length, and a water jacket cavity including portions in encircling relation to the exhaust passage portions. The method comprises the steps of providing a mold cavity which defines the exterior surface of the engine block, locating one or more disposable cores in the mold cavity so as to provide for the exhaust passage portions and for the water jacket cavity, filling the mold cavity with molten metal to provide a unitarily cast engine block, permitting solidification of the block with the cores contained therein, and removing the disposable cores from within the engine block to provide the hollow exhaust passage portions and the water jacket cavity.

U.S. Pat. No. 4,457,727, which issued to Flaig on Jul. 3, 1984, discloses a marine propulsion device engine cooling system. The device is provided with a flow of cooling water through the engine. The flow is controlled by a thermostat which controls the flow of cooling water in response to change in the temperature of the engine when the engine is operated at a low speed. The thermostat is supported in a flow restricting position when the engine speed is low, but is moved to a position providing for increased water flow when the engine reaches the increased speed.

U.S. Pat. No. 4,357,912, which issued to Brown on Nov. 9, 1982, discloses an engine cooling system for a marine propulsion device. The internal combustion engine has a water jacket with an inlet portion, a second portion, and a valve for communicating between the inlet portion and the second portion. It also comprises a valve member moveable relative to the valve port between open and closed positions, a recess extending from the inlet portion, a moveable wall connected to the valve member for actuation thereof between the open and closed positions wherein the movable wall has opposite first and second sides and extends across the recess to define a chamber located in the recess. It is subject to the pressure of the water in the inlet portion. The system also comprises a water pump driven by the engine which has a discharge outlet. A water supply conduit, which communicates with the discharge outlet and with the water jacket inlet includes an overboard discharge branch conduit communicating with the atmosphere. It also includes a duct communicating with the chamber and with the overboard discharge branch conduit. Furthermore, it comprises a valve in the overboard discharge branch conduit downstream of the connection with the duct and operable selectively to open and close the overboard discharge branch conduit relative to the atmosphere.

U.S. Pat. No. 3,908,579, which issued to Miller et al on Sep. 30, 1975, describes an outboard motor with a dual cooling system. The outboard motor includes a propulsion unit connected to a boat attachment element for providing vertical and horizontal swinging movement of the propulsion unit relative to the boat. The propulsion unit includes a rotary internal combustion engine including a first housing assembly comprising wall surfaces defining aligned first and second trochoid shaped rotor cavities and additional wall surfaces defining a first water jacket system adjacent to the first and second rotor cavities and having inlet and outlet ports. Together with a second housing assembly, it comprises wall surfaces defining aligned third and fourth trochoid shaped rotor cavities and additional wall surfaces defining a second water jacket system adjacent to the third and fourth rotor cavities and having inlet and outlet ports. Bolts secure together the first and second housing assemblies. The system further comprises a lower unit rigidly supporting the engine and including a propeller that is rotatably supported by the lower unit and operatably connected to the engine. A water pump, driven by the engine and having an inlet communicated with the water, is also provided along with a water conduit communicating between the pump and separately with each of the first and second water jacket system inlet ports.

All of the United States patents identified above by number are hereby expressly incorporated by reference in this description.

Many types of engine cooling systems utilize a thermostat and a pressure responsive valve to control the flow of coolant through the engine. The engine cooling system should ideally accomplish several goals. First, the cylinder block should be cooled sufficiently to prevent distortion or damage resulting from the extensive heat generated at the cylinder walls of the engine. Secondly, the cylinder head should be maintained at an efficient operating temperature. If the cylinder head is too cold, the operation of the engine is compromised. On the other hand, if the cylinder head is too hot, distortion and damage can occur. These problems can be exacerbated when the engine is operated on a cold body of water. Since water is typically drawn into the intake of the outboard motor from the body of water on which the motor is used, changes in the temperature of that water can adversely affect the operation of the engine. Typically, a thermostat is used to regulate the rate of flow of coolant through the cylinder head. A pressure responsive valve is used to regulate the flow of water through the cylinder block.

As an example of how an engine can respond inappropriately to its surrounding conditions, an outboard motor made according to the prior art being run at full speed on a cold lake could experience difficulty if the flow through both the cylinder block and cylinder head is controlled by the pressure responsive valve since the increased speed of the engine will open the valve regardless of the temperature. This could result in the cylinder head failing to reach appropriate operating temperatures. On the other hand, at low speeds when the pressure responsive valve remains closed, certain engine coolant schemes in the prior art control all of the water flow through the engine as a function of the thermostat. The cold lake water could retard the operation of the thermostat, which is most sensitive to the temperature of the water in the cylinder head, and result in an overheating condition in the cylinder block.

It would therefore be significantly beneficial if an engine cooling system could be developed which controls the rate of flow of coolant through the cylinder block as a function of engine speed, but also controls the rate of flow of coolant through the cylinder head as a function of temperature, regardless of the speed of operation of the engine.

SUMMARY OF THE INVENTION

A cooling system for an engine made in accordance with the present invention comprises a cylinder formed in a cylinder block. A piston is disposed in the cylinder for reciprocating movement therein. A cylinder head is attached to the cylinder block, the piston, the cylinder and the cylinder head define a chamber in which combustion occurs during the operation of the engine. That combustion generates heat.

In a preferred embodiment of the present invention, a first coolant conduit is disposed within and in thermal communication with the cylinder block and a first drain is connected in serial fluid communication with the first coolant conduit. A second coolant conduit is disposed within and in thermal communication with the cylinder head and a second drain is connected in serial fluid communication with the second coolant conduit. The first and second drains are disposed in parallel with each other.

A pressure responsive valve is disposed in fluid communication with the first coolant conduit and with the first drain. A temperature responsive valve is disposed in fluid communication with the second coolant conduit and with the second drain. The temperature responsive valve controls the rate of flow of the fluid through the second coolant conduit. The pressure responsive valve controls the rate of flow of fluid through the first drain and through the second coolant conduit. The pressure responsive valve causes generally all of the flow of fluid passing through the first coolant conduit to flow through the second coolant conduit when the fluid is at a pressure which is less than a preselected threshold magnitude, when the temperature sensitive valve permits such flow, and the pressure responsive valve causes a portion of the fluid to flow through the first drain when the fluid is at a pressure greater than the preselected threshold. In other words, when the pressure responsive valve is closed, at low pressure values of the coolant, virtually all of the coolant that flows through the cylinder block also flows through the cylinder head. Of course, if the temperature responsive valve is closed because of low coolant temperature, only a very small flow occurs. If, on the other hand, the pressure responsive valve is opened because of increased coolant pressure, a significant portion of the total flow through the cylinder block is discharged back into the lake without having to pass through the cylinder head. A portion of the water flowing through the cylinder block will continue to flow through the cylinder head if the temperature responsive valve is opened.

The first and second coolant conduits, which run through the cylinder block and cylinder head respectively, are disposed in serial fluid communication with each other. The second coolant conduit can also be disposed in serial fluid communication between the first coolant conduit and the temperature responsive valve. The temperature responsive valve can be disposed in serial fluid communication between the second coolant conduit and the second drain.

The pressure responsive valve can be disposed in serial fluid communication between the first coolant conduit and the first drain. The system can comprise a pump that is connected to the first coolant conduit for causing the fluid to flow through the first coolant conduit. The first coolant conduit can be disposed in serial fluid communication between the pump and the second coolant conduit.

The engine can be an internal combustion engine and can be used to provide power for an outboard motor.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
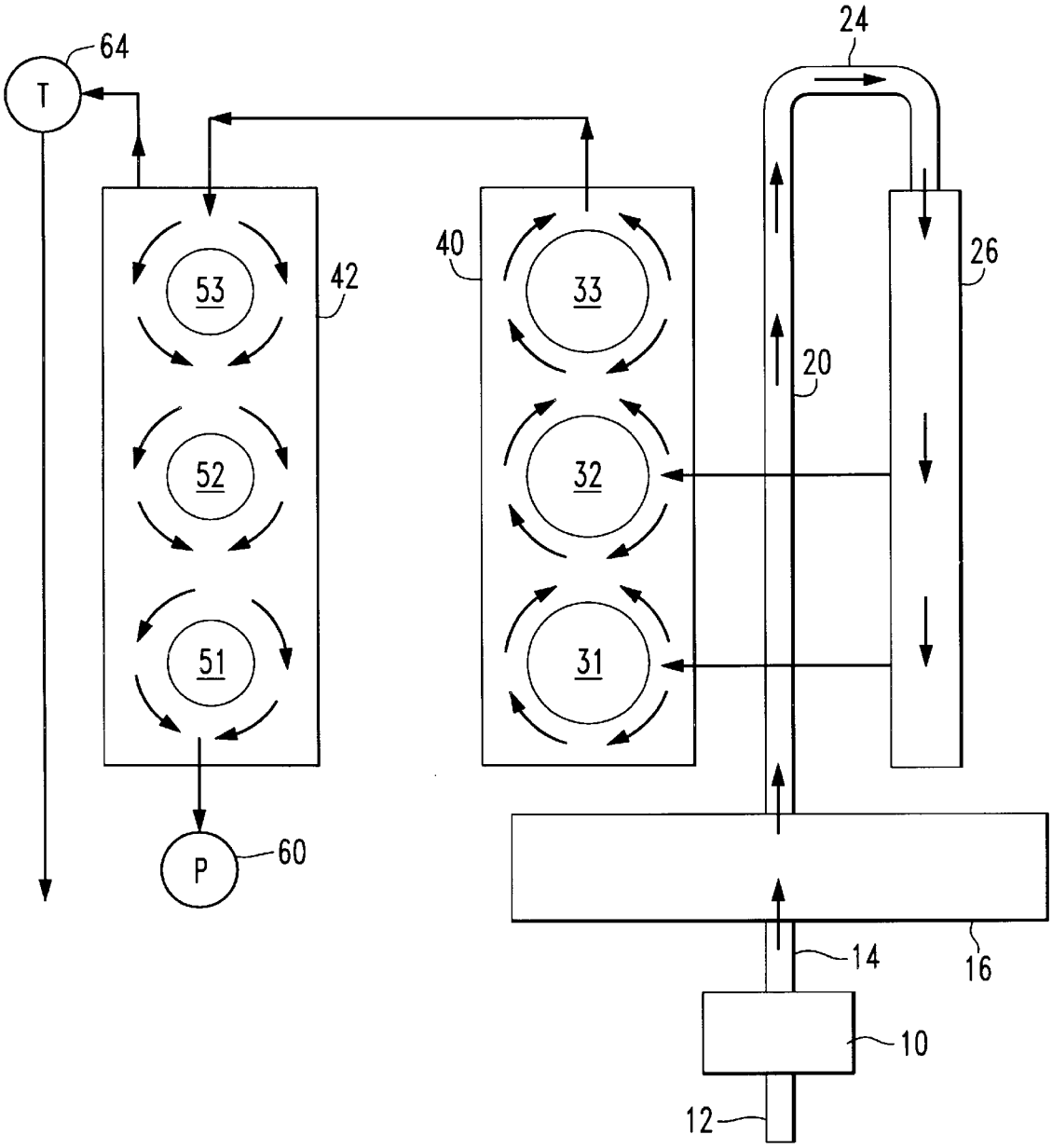
FIG. 1 PRIOR ART
FIG. 1 is a schematic representation of a portion of a conventional cooling system for an engine.

Throughout the description of the preferred embodiment, like components will be identified by like reference numerals.

In FIG. 1, a known cooling system is illustrated schematically. A pump 10 draws water, through an inlet 12, from a source such as a lake on which the engine is used. The water is pumped through tube 14 and then through a housing 16 of the outboard motor. The component identified by reference numeral 16 in FIG. 1 represents the driveshaft housing and its associated adapter plates that are located below the internal combustion engine of an outboard motor. The water then continues up through a water inlet 20 which, in a typical application, comprises a centrally located opening which extends vertically through the engine block. Near a top portion of the engine block, the upwardly flowing coolant is caused to reverse directions, at bend 24, and flow downward through a water jacket 26 which surrounds the exhaust port of the engine block.

With continued reference to FIG. 1, the coolant is then caused to flow from the water jacket 26 into a region which surrounds the cylinders 31–33 at one side of the engine. As can be seen by the arrows in FIG. 1, the water flows in parallel around the cylinders and its precise course is determined by the relative pressures located in the cooling channels around the cylinders and the relative flow restrictions that the coolant experiences as it moves around the cylinders. Eventually, the water moves upward through the cylinder block 40 and is conducted to the cylinder head 42. As it passes downward through the cylinder head, the coolant flows in a parallel fashion around the domes in the cylinder head which define the combustion chambers of the engine. These domes are identified by reference numerals 51–53. It should be understood that in a typical application of a cooling system such as that illustrated in FIG. 1 dome 53 would be associated with cylinder 33, and so on, with the domes being disposed directly in line within the cylinder.

The water in the cylinder head 42 can be discharged in either of two ways. If the pressure of the coolant within the cylinder head 42 exceeds a preselected threshold, a pressure sensitive valve 60 will open and allow the coolant to be discharged back into the body of water from which it was taken. It should be understood that the pressure sensitive valve 60 is typically a poppet-type valve which, once opened, opens completely as long as the pressure threshold is exceeded. The other way by which the coolant in the cylinder head can be discharged is through the temperature responsive valve 64. This valve, typically a thermostat, responds to the coolant temperature within the cylinder head 42 and opens by an amount dictated by the operating characteristics of the thermostat 64 and the temperature of the coolant which is in thermal communication with the thermostat.

FIG. 1 shows one half of a six cylinder engine. It should be understood that another cylinder block 40 and cylinder head 42 would be disposed on the right side of the water inlet 20 and the water jacket 26.

With continued reference to FIG. 1, it can be seen that if the pressure responsive valve is opened because the engine is running at high speed, the total flow of water passing through the cylinder block 40 will pass through the cylinder head 42, regardless of the temperature to which the temperature responsive valve 64 is exposed. This situation could result in a cylinder head temperature that is lower than optimum.

Figure 2:
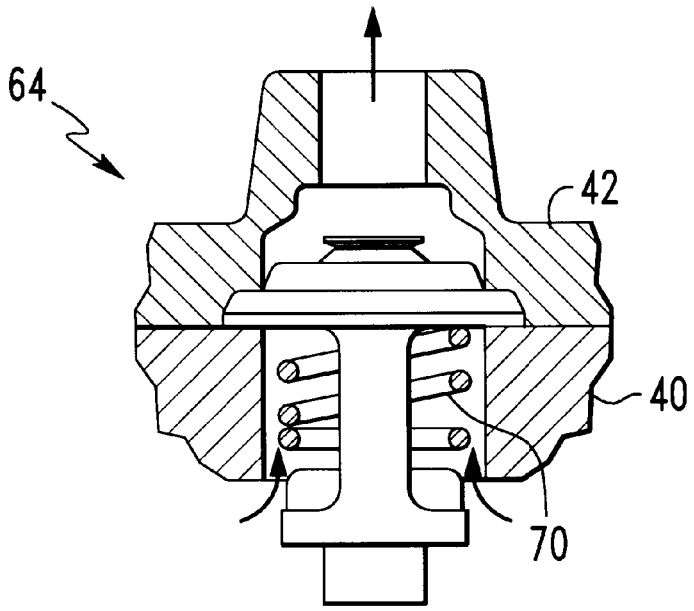
FIG. 2 PRIOR ART
FIG. 2 shows a known thermostat structure.

FIG. 2 shows a thermostat 64 which is generally known to those skilled in the art. If the spring 70 expands in response to increased temperature of the fluid surrounding it, the coolant flows through the thermostat. Typically, the thermostat 64 is disposed at a juncture where the cylinder block 40 is attached to the cylinder head 42.

Figure 3:
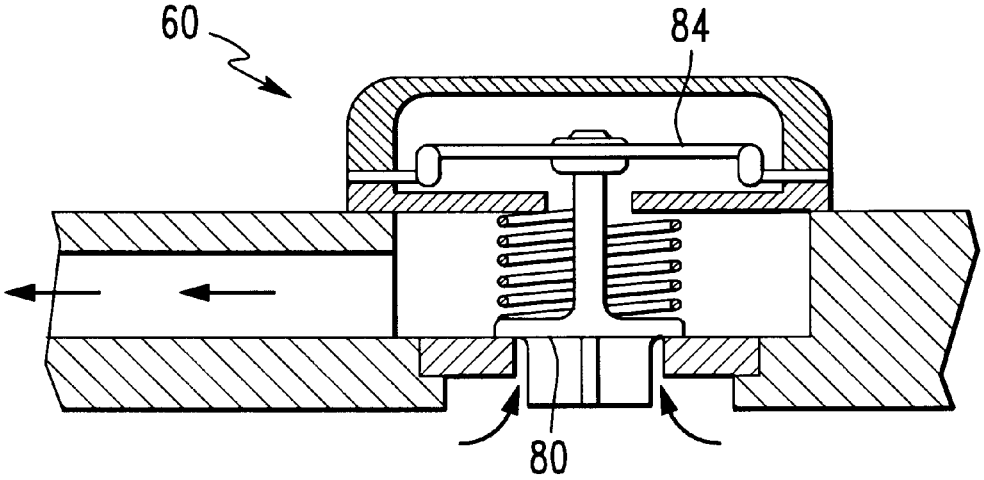
FIG. 3 PRIOR ART
FIG. 3 shows a known pressure responsive valve structure.

FIG. 3 shows a pressure responsive valve 60 which is generally known to those skilled in the art. If coolant pressure is sufficient to exert a force against a first area 80 to overcome the force of the spring 82, the coolant pressure will then be sufficient to exert a larger force against a larger area 84 to hold the valve open. The valve will remain open until the coolant pressure drops sufficiently to reclose the pressure responsive valve 60 under the force of spring 82. The thermostat in FIG. 2 and the pressure valve in FIG. 3 are both well known to those skilled in the art and will not be described in greater detail herein.

Figure 4:
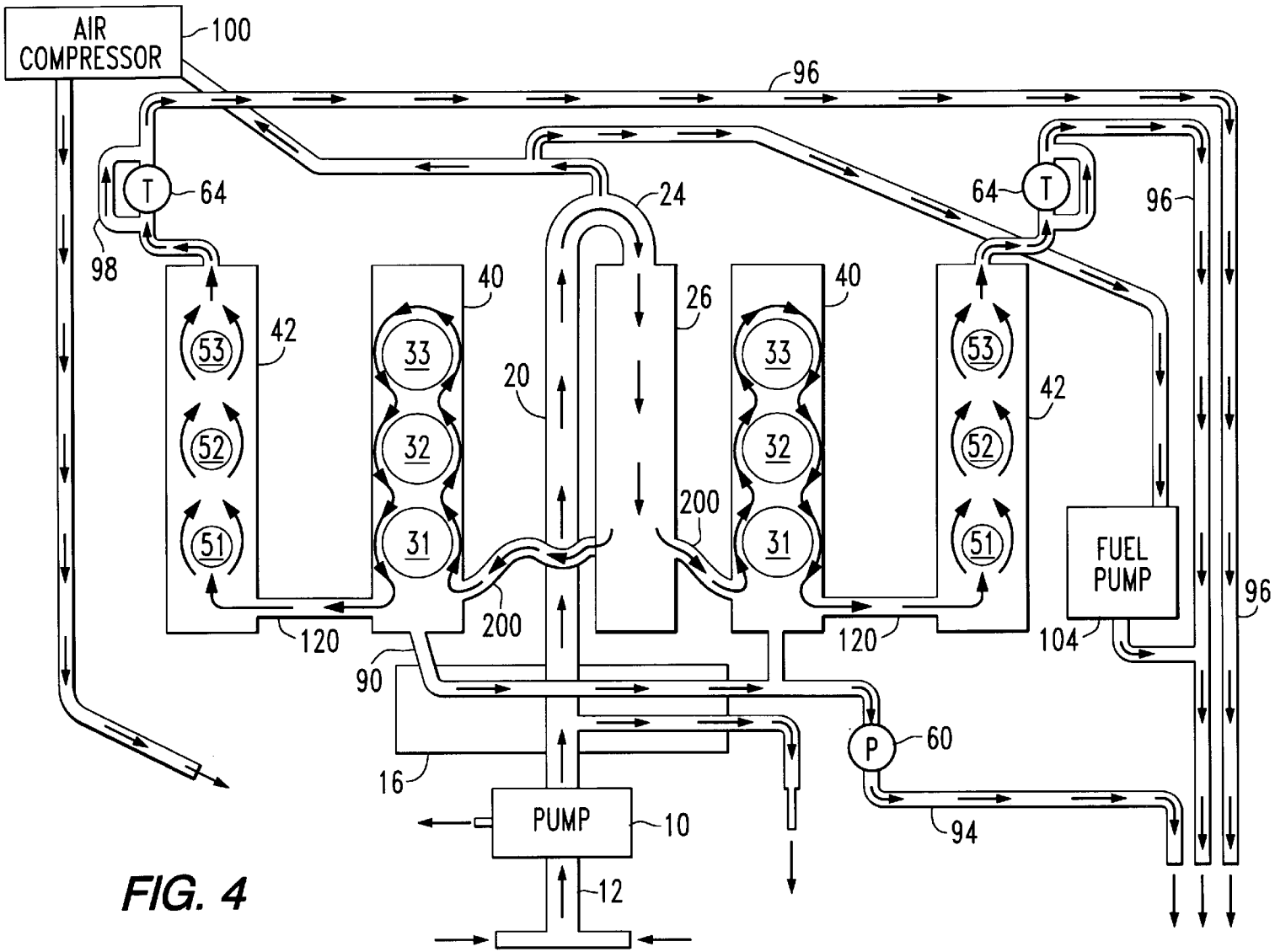
FIG. 4 is a schematic representation of a cooling system for an engine incorporating the concept of the present invention.

FIG. 4 shows a simplified schematic of the present invention. A pump 10 draws water through an inlet 12 which is typically disposed below the level of the lake in which the outboard motor is operated. The inlet passage 20 conducts the water upward through the central portion of the cylinder block until it is diverted, by bend 24 to flow downward through the water jacket 26 which surrounds the exhaust port of the engine. With particular reference to the left side of FIG. 4, the water then flows into the cylinder block 40 at its bottom portion. Unlike the flow pattern described above in conjunction with FIG. 1, the flow through the cylinder block 40 in a preferred embodiment of the present invention, the coolant is directed in a serial path around the cylinders. First, it passes upward along one side of cylinders 31–33 and then, at the upper portion of the cylinder block 40, it flows around cylinder 33 and begins to flow downward along the opposite side of the cylinders. It has been found that serial coolant flow is significant preferable to parallel coolant flow because it assures that every portion of the coolant passage receives a full flow of coolant. In parallel flows, certain portions of the coolant passage can be deprived of coolant flow because of variations in flow resistances and passage sizes within the engine block.

After flowing serially through the cylinder block 40, the coolant is directed to the cylinder head 42 where it flows around the domes 51–53 in a generally parallel fashion. The thermostat 64 will permit flow through it when the coolant temperature within the cylinder head 42 exceeds a predetermined threshold. Above that threshold, the rate of flow through the thermostat 64 will be determined by the operating characteristic of the thermostat and the temperature of the coolant within the cylinder head.

At the bottom portion of the cylinder head 40, a fluid connection 90 connects the cylinder block 40 with the pressure sensitive valve 60. When the pressure sensitive valve 60 is opened, fluid is allowed to flow through a first drain 94 to be discharged back into the body of water from which the water was originally drawn.

With continued reference to FIG. 4, the water passing through the temperature sensitive valve 64 flows through a second drain 96 and is discharged into the body of water from which it was originally drawn. It can be seen that the temperature responsive valve 64 is provided with bypass conduit 98 that allows coolant to flow around the temperature responsive valve 64 under all conditions regardless of the temperature. This is provided to assure a slight flow of coolant through the cylinder head so that the temperature upstream from the temperature responsive valve 64 is reflected in the temperature experienced by the thermostat.

Several other coolant paths are shown in FIG. 4, but they do not directly affect the operation of the present invention. For example, some coolant is diverted as it passes through portion 24 from the inlet passage 20 to the water jacket 26. This diverted flow passes to both the air compressor 100 and the fuel pump 104. After passing through the air compressor 100 and fuel pump 104, this diverted flow of coolant is discharged into the body of water in which the pump originally drew it.

The cylinder block 40 and the cylinder head 42 shown on the right side of FIG. 4 operate in the manner generally identical to that described above. Both sides of the six cylinder engine are physically identical to each other in this respect. They share a common pressure responsive valve 60 as shown in FIG. 4.

Figure 5:
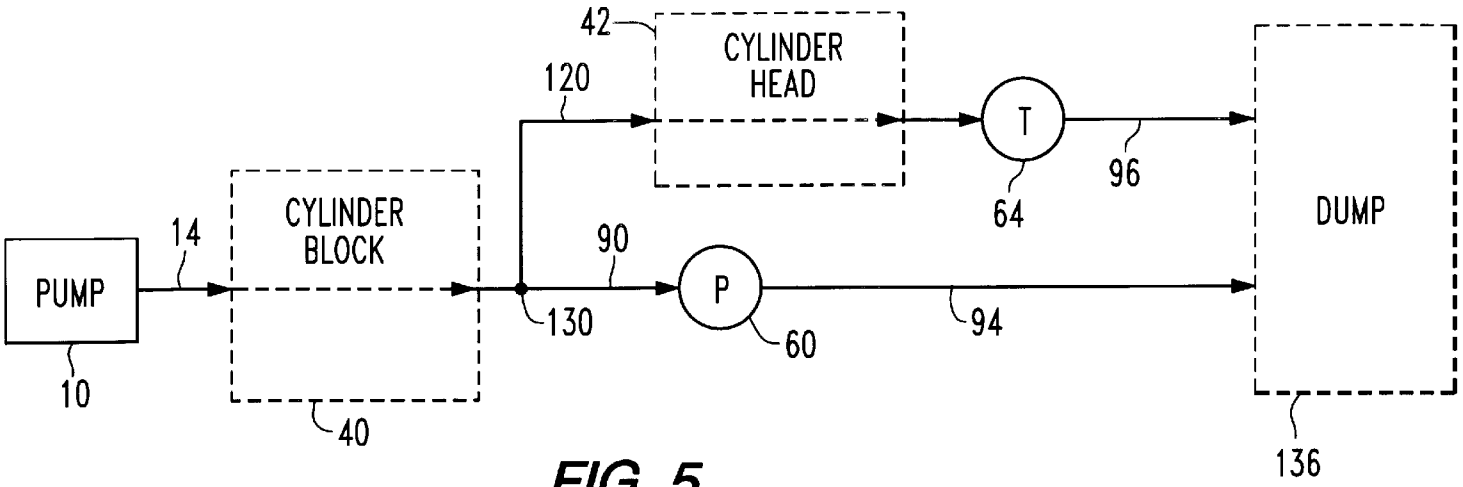
FIG. 5 is a highly schematic block diagram of the present invention.
Figure 6:
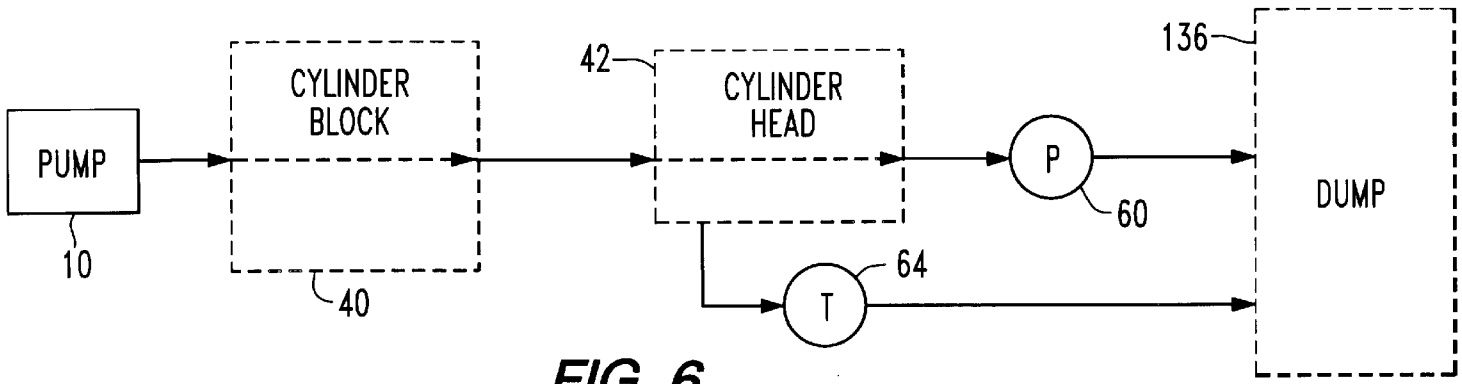
FIG. 6 PRIOR ART
FIG. 6 is a highly schematic block diagram of a cooling system made in accordance with the prior art.

In order to more fully understand the differences between the present invention and the prior art, FIGS. 5 and 6 show highly simplified schematic representations of the present invention and one example of a prior art cooling system, respectively. In FIG. 5, the pump 10 causes water to flow through conduit 14 into the cylinder block 40. The passage through the cylinder block 40 is connected to a junction which divides the flow into two possible streams. One possible stream passes through conduit 90 toward the pressure responsive valve 60 and the other possible stream passes through conduit 120 toward the cylinder head 42. This junction, identified by reference numeral 130, is an important difference between the present invention and the prior art. When the pressure responsive valve 60 is closed, as the engine is operated at low speeds, all of the coolant flowing through the cylinder block 40 is forced to pass through the cylinder head 42. It should be understood that this flow through the cylinder block and cylinder head can be virtually zero if the temperature responsive valve 64 is closed. If both the pressure responsive valve 60 and temperature responsive valve 64 are closed, essentially no flow will exist through the engine until either the pressure rises or the temperature in the cylinder head 42 rises. When the pressure of the coolant exceeds the threshold of the pressure responsive valve 60, the coolant is allowed to flow directly through the cylinder block and through the first drain 94 so that it can be discharged. The dump 136 represents the lake or body of water on which the engine is operated. Under these conditions, with the pressure responsive valve 60 opened, the water passing through the cylinder block 40 does not experience the resistance to its flow that it would experience if it also had to flow serially through the cylinder head 42. Therefore, regardless of the temperature of the coolant within the cylinder head 42, the cylinder block 40 will experience a significant flow of coolant through it when the engine exceeds the preselected speed that results in the pressure threshold of the pressure responsive valve 60. In addition, this increased flow through the cylinder block 40 does not increase the flow through the cylinder head 42 unless its coolant temperature within the cylinder head causes the temperature responsive valve 64 to open and permit that flow. Therefore, if the cylinder head 42 is not at an appropriate temperature for proper operation, the temperature responsive valve 64 will remain closed until the temperature of the cylinder head is appropriately raised. However, this intentional raising of the cylinder head temperature will not adversely affect the cooling of the cylinder block 40 which is controlled by the pressure responsive valve 60.

Although various embodiments of the present invention will result in different ratios of flow through conduit 120 and conduit 90, it has been determined that when the pressure responsive valve 60 is opened, the flow through conduit 120 will generally be in a range from 15% to 60% of the total flow through the pump end and cylinder block 40. The remaining flow will be discharged through the first drain 94. The percentage of the total flow through cylinder block 40 which passes through conduit 120 will be determined partially by the temperature of the water drawn by the pump 10 from the body of water on which the engine is operated. For example, if the engine is operated on a body of cold water (e.g. water temperatures of approximately 40 deg. F.), approximately 10 to 30% of the water drawn by the pump 10 will pass through conduit 120 and the cylinder head 42. On the other hand, if the water temperature of the body of water is significantly warmer than the previous example, 50 to 60% of the water drawn by the pump 10 can pass through the cylinder head 42. Of course, it should be realized that the water passing through the cylinder head 42 is a direct function of the status of the temperature responsive valve 64. In other words, if the water temperature is below that which begins to open the temperature responsive valve 64, there will be very little flow through the cylinder head 42 regardless of the condition of the pressure sensitive valve 60.

FIG. 6 is a highly simplified schematic of the prior art cooling system described above in conjunction with FIG. 1. The pump 10 moves the stream of water through the cylinder block 40 and all of the water passing through the cylinder block 40 is directed to the cylinder head 42. This represents a significant difference from the present invention since the present invention does not always pass all of the water to the cylinder head. After passing through the cylinder head, the water experiences a pressure responsive valve 60 which determines whether or not the coolant flow will be discharged to the dump 136, such as a lake. The temperature responsive valve 64 is connected to the cylinder head in the upper portion of the engine as illustrated in FIG. 1.

Functionally, the systems in FIGS. 5 and 6 are significantly different. For example, if the pressure sensitive valve 60 in FIG. 6 opens because the engine is operated at high speed, the coolant will be caused to flow through the cylinder head 42 at maximum speed and reduce the temperature of the cylinder head correspondingly. This is disadvantageous if the cylinder head is operating below its preferred operating temperature. Nonetheless, the operation of the cooling system is completely dictated by the status of the pressure responsive valve 60. By comparing FIGS. 5 and 6, it can be seen that the cylinder head 42 of the present invention is controlled primarily by the temperature responsive valve 64 while the cylinder block 40 is controlled primarily by the pressure responsive valve 60. Although these two coolant circuits are interdependent to some degree, this arrangement is highly preferably to that of the prior art shown in FIG. 6 because it satisfies several desirable running conditions of a marine engine. The cylinder block will tend to rise in temperature as a function of the speed of the engine. Therefore, the cylinder temperature can rise significantly even though the coolant at the temperature responsive valve 64 has not yet reached that same temperature. This could result in damage to the cylinder block 40 when the engine is run at high speed. The present invention avoids this possible problem by controlling the flow of coolant through the cylinder block 40 as a function of the pressure of the coolant and not the condition of the thermostat. Another advantage of the present invention is that it does not determine the flow rate of coolant through the cylinder head 42 as a function of engine speed. Even if the engine is operated at a high speed, and therefore higher pressure, the flow rate of coolant through the cylinder head 42 is determined by the temperature of the coolant in the cylinder head measured by the temperature responsive valve 64.

Figure 7:
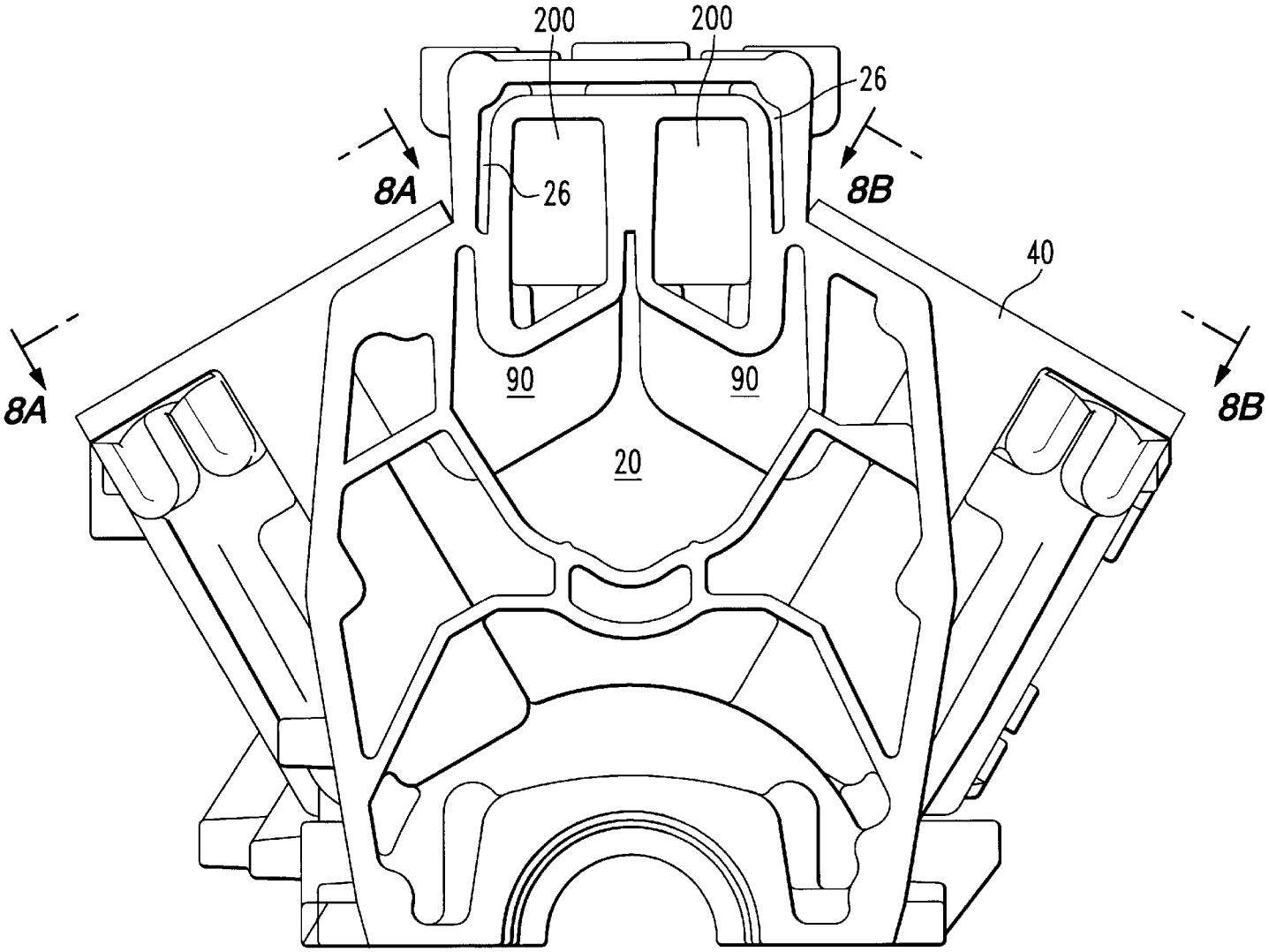
FIG. 7 is a bottom view of a six cylinder engine incorporating the concepts of the present invention.

FIG. 7 shows a bottom view of the end of the cylinder block 40. It should be understood that the surface shown in FIG. 7 is a bottom surface of the engine when it is in operation. It is bolted to the adapter plates and driveshaft housing 16 represented by a box in the previous figures. When the water is introduced to the engine by the pump 10 (as shown in FIG. 4) it passes through the water inlet 20 in a direction generally upward through a body of the engine. After being diverted by passage 24, it travels downward through the water jacket surrounding the exhaust ports 200. The passages shown in FIGS. 4 and 7 provide the initial path of the coolant after it is discharged by the pump 10 and prior to entering the coolant channels that surround the cylinders within the cylinder block 40.

Figure 8A:
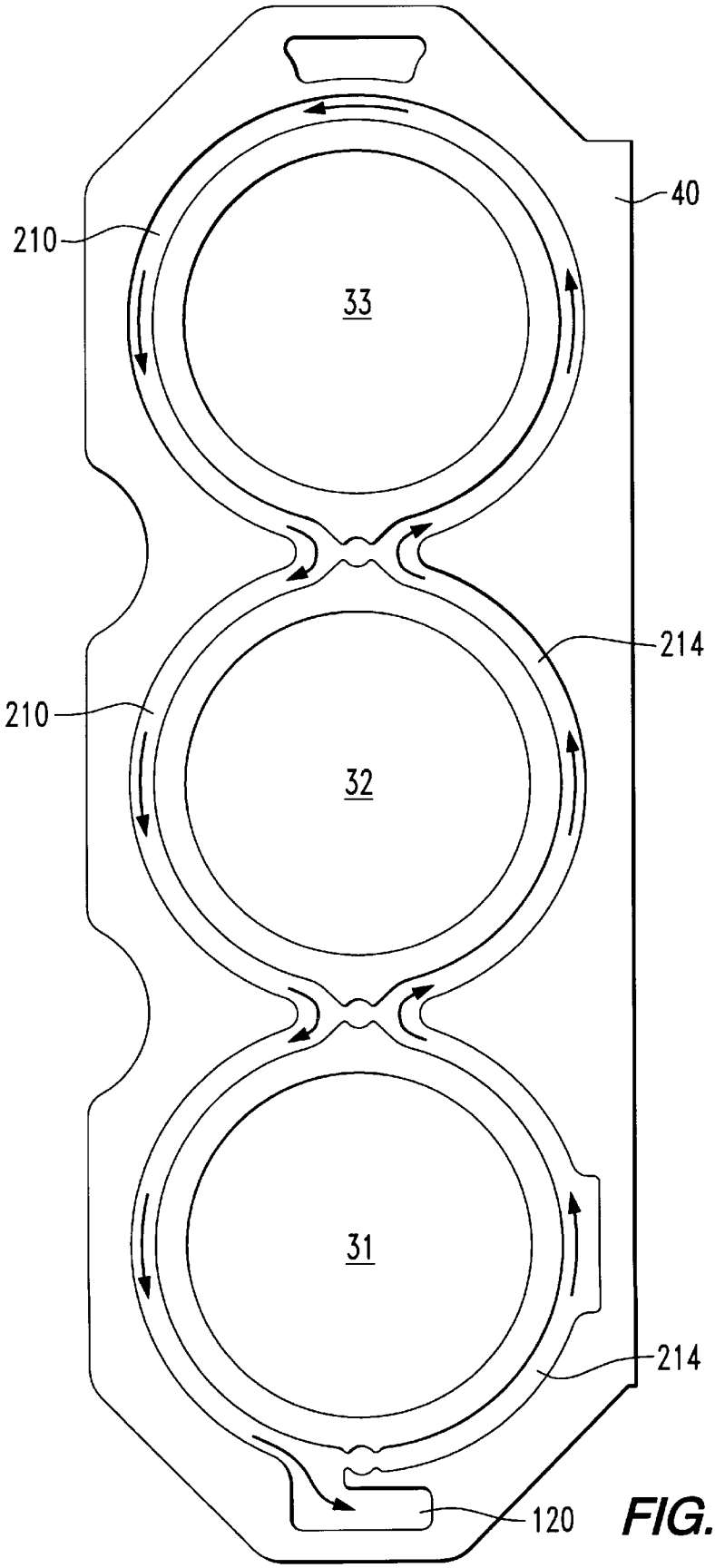
FIGS. 8A and 8B show views of the cylinder banks of the engine illustrated in FIG. 7.
Figure 8B:
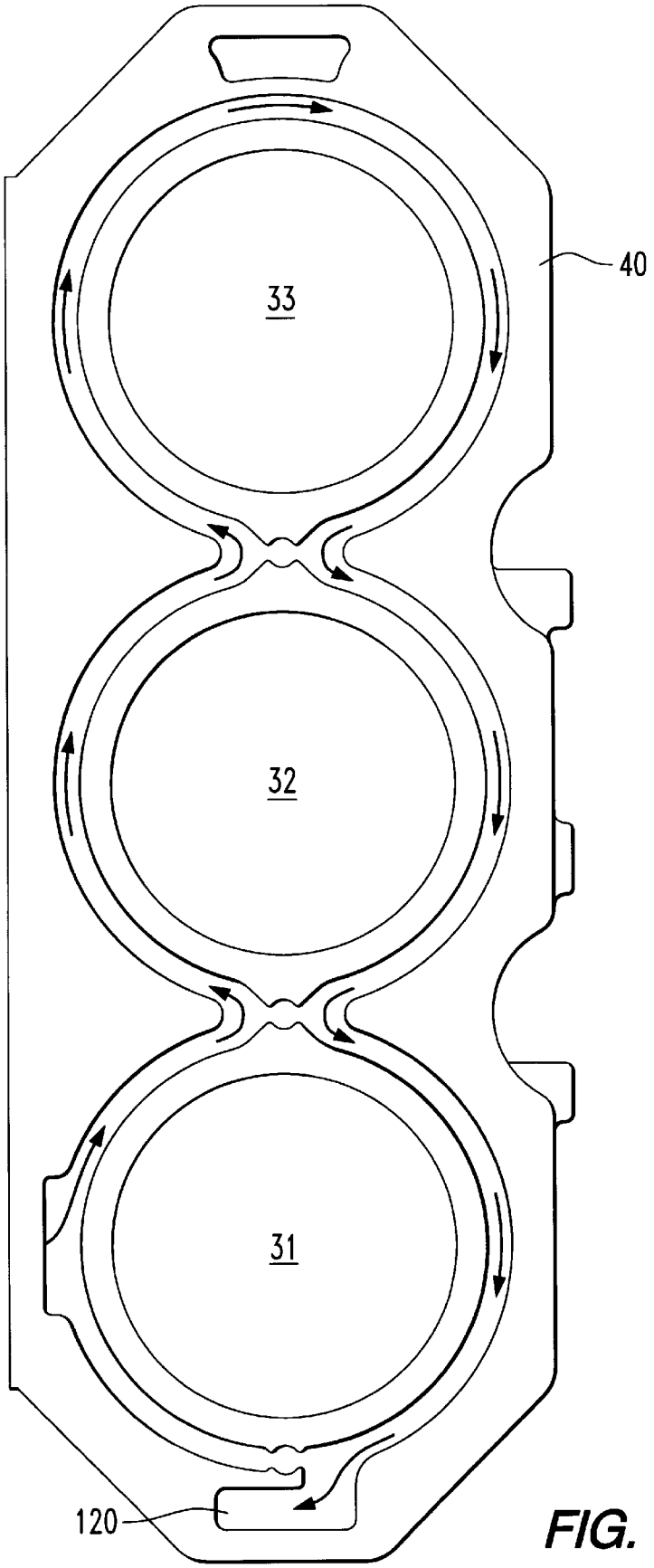

FIGS. 8A and 8B show the surfaces surrounding the cylinder openings of the cylinder block 40 shown in FIG. 7. FIG. 8A shows the three cylinders, 31–33, on the left side of FIG. 7 and FIG. 8B shows the three cylinders 31–33 on the right side of FIG. 7. Because these cylinders and their respective cooling channels are mirror images of each other, they have been identified by similar reference numerals. FIGS. 8A and 8B are shown with the cylinder heads removed.

In FIG. 8A, the water enters through opening 200 and flows upward along cooling channel 210 which extends along one side of the three cylinders 31–33. As represented by the arrows in FIG. 8A, the coolant then reaches the upper portion of the engine block and turns into channel 214 along the opposite side of the cylinder 31–33. FIG. 8B shows the same type of coolant passage for the other three cylinders on the opposite side of the engine. In FIGS. 8A and 8B, the illustrations show the general structure of the passages and their locations chosen to facilitate the operation of the present invention.

Figure 9:
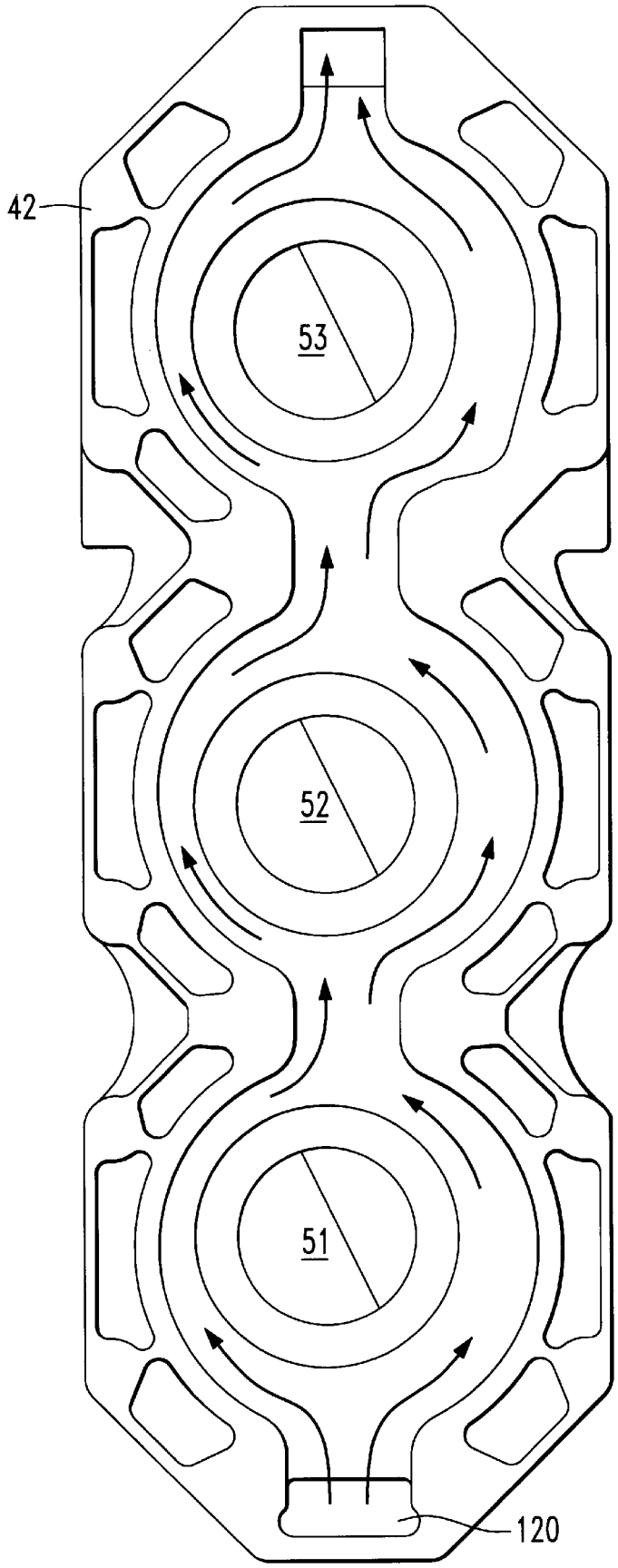
FIG. 9 shows a view of the second cooling conduit through the combustion head of an engine.

FIG. 9 shows a cut-away view of the cylinder head 42. A top portion of the cylinder head 42 is removed to expose the domes 51–53 which define the combustion chambers of the cylinders. The coolant passage around the domes results in a generally parallel flow of coolant from bottom to top after entering the combustion head 42 through passage 120. After completing the path through the cylinder head 42, the coolant flows the second drain 96 and is discharges back into the body of water from which it was drawn by the pump 110.

With reference to FIGS. 4 and 5, the basic elements of the present invention comprise a cylinder block 40 in which a plurality of cylinders 31–33 are formed. Although not specifically shown in FIG. 4, each cylinder is associated with a piston which is disposed in the cylinder for reciprocating movement therein, in a manner which is very well known to those skilled in the art. A cylinder head 42 is attached to the cylinder block 40 and a chamber is defined by the piston, the cylinder and the cylinder head. Combustion occurs within the chamber during the operation of the engine and generates heat. A first coolant conduit, represented by the dashed line extending through the cylinder block 40, is disposed within and in thermal communication within the cylinder block. In a typical application, this first coolant conduit comprises one or more channels 210 and 214 that are formed around the cylinders 31–33 to direct the coolant along one side of a bank of cylinder and then in the opposite direction along the opposite side along the same bank of cylinders. A first drain 94 is connected serial fluid communication with the first coolant conduit. This relationship is shown in FIG. 5 in the coolant path that comprises the cylinder block 40, junction 130, the transfer passage 90, the pressure sensitive valve 60, and the first drain 94.

As also shown in FIG. 5, the present invention comprises a second coolant conduit which is represented by the dashed line extending through the cylinder head 42. This second coolant conduit passes through the cylinder head 42 and around the domes 51–53 which define the combustion chambers. The flow path through the cylinder head 42, in one particular preferred embodiment of the present invention, comprises parallel paths around the combustion chamber domes. A second drain 96 is connected in serial fluid communication with the second coolant conduit. The first and second drains, 94 and 96 are disposed in parallel association with each other.

A pressure responsive valve 60 is disposed in fluid communication with the first coolant conduit through the cylinder block 40 and the first drain 94. A temperature responsive valve 64 is disposed in fluid communication with the second coolant conduit through the cylinder head 42 and the second drain 96. The temperature responsive valve controls the rate of flow of coolant through the second coolant conduit of the cylinder head 42. The pressure responsive valve 60 controls the rate of flow of coolant through the first drain 94 and through the second coolant conduit of the cylinder head 42. More specifically, the state of the pressure responsive valve 60 will determine if any of the coolant flows through the first drain 94. This determination also has an effect on the percentage of the total flow which passes through the second coolant conduit of the cylinder head. The pressure responsive valve 60 causes generally all of the flow of the coolant passing through the first coolant conduit of the cylinder block to flow through the second coolant conduit of the cylinder head when the coolant is at a pressure less than at a preselected threshold magnitude and when the temperature responsive valve 64 permits such flow. In other words, if the temperature responsive valve 64 is completely closed, no significant flow can occur through the cylinder head 42 regardless of the state of the pressure responsive valve 60. The pressure responsive valve 60 causes a portion of the coolant to flow through the first drain 94 when the fluid is at a pressure greater than the preselected threshold magnitude.

As shown in FIG. 5, the first coolant conduit through the cylinder block 40 and the second coolant conduit through the cylinder head 42 are disposed in serial fluid communication with each other. The second coolant conduit through the cylinder head 42 is disposed in serial fluid communication between the first coolant conduit of the cylinder block 40 and the temperature responsive valve 64 in one particular preferred embodiment of the present invention. In addition, the temperature responsive valve 64 is disposed in serial communication between the second coolant conduit of the cylinder head 42 and the second drain 96. The pressure responsive valve 60 is disposed in serial communication between the first coolant conduit of the cylinder block 40 and the first drain 94. A pump 10 is connected to the first coolant conduit through the cylinder block 40 for causing the coolant to flow through the first coolant conduit. The first coolant conduit is disposed in serial fluid communication between the pump 10 and the second coolant conduit through the cylinder head 42.

Although the present invention has been described in particular detail and illustrated to show one embodiment, it should be understood that modifications of the present invention are also within its scope.

We claim:

1. A cooling system for an engine, comprising:

a cylinder formed in a cylinder block;

a piston disposed within said cylinder for reciprocating movement therein;

a cylinder head attached to said cylinder block, said piston, said cylinder and said cylinder head defining a chamber in which combustion occurs during operation of said engine, said combustion generating heat;

a first coolant conduit disposed within and in thermal communication with said cylinder block;

a first drain connected in serial fluid communication with said first coolant conduit;

a second coolant conduit disposed within and in thermal communication with said cylinder head;

a second drain connected in serial fluid communication with said second coolant conduit, said first and second drains being disposed in parallel association with each other;

a pressure responsive valve disposed in fluid communication with said first coolant conduit and said first drain; and a temperature responsive valve disposed in fluid communication with said second coolant conduit and said second drain, said temperature responsive valve controlling the rate of flow of a coolant through said second coolant conduit, said pressure responsive valve controlling the rate of flow of said coolant through said first drain and through said second coolant conduit, said pressure responsive valve causing generally all of the flow of said coolant passing through said first coolant conduit to flow through said second coolant conduit when said coolant is at a pressure less than a preselected threshold magnitude when said temperature sensitive valve permits such flow, said pressure responsive valve causing a portion of said coolant to flow through said first drain when said coolant is at a pressure greater than said preselected threshold.

2. The system of claim 1, wherein:

said first and second coolant conduits are disposed in serial fluid communication with each other.

3. The system of claim 1, wherein:

said second coolant conduit is disposed in serial fluid communication between said first coolant conduit and said temperature responsive valve; and said temperature responsive valve is disposed in serial fluid communication between said second coolant conduit and said second drain.

4. The system of claim 1, wherein:

said pressure responsive valve is disposed in serial fluid communication between said first coolant conduit and said first drain.

5. The system of claim 1, further comprising:

a pump connected to said first coolant conduit for causing said coolant to flow through said first coolant conduit.

6. The system of claim 5, wherein:

said first coolant conduit is disposed in serial fluid communication between said pump and said second coolant conduit.

7. The system of claim 1, wherein:

said engine is an internal combustion engine.

8. The system of claim 1, wherein:

said engine provides power for an outboard motor.

9. A cooling system for an engine, comprising:

a cylinder formed in a cylinder block;

a piston disposed within said cylinder for reciprocating movement therein;

a cylinder head attached to said cylinder block, said piston, said cylinder and said cylinder head defining a chamber in which combustion occurs during operation of said engine, said combustion generating heat;

a first coolant conduit disposed within and in thermal communication with said cylinder block;

a first drain connected in serial fluid communication with said first coolant conduit;

a second coolant conduit disposed within and in thermal communication with said cylinder head, said first and second coolant conduits being disposed in serial fluid communication with each other;

a second drain connected in serial fluid communication with said second coolant conduit, said first and second drains being disposed in parallel association with each other;

a pressure responsive valve disposed in fluid communication with said first coolant conduit and said first drain; and a temperature responsive valve disposed in fluid communication with said second coolant conduit and said second drain, said temperature responsive valve controlling the rate of flow of a coolant through said second coolant conduit, said pressure responsive valve controlling the rate of flow of said coolant through said first drain and through said second coolant conduit, said pressure responsive valve causing generally all of the flow of said coolant passing through said first coolant conduit to flow through said second coolant conduit when said coolant is at a pressure less than a preselected threshold magnitude when said temperature sensitive valve permits such flow, said pressure responsive valve causing a portion of said coolant to flow through said first drain when said coolant is at a pressure greater than said preselected threshold.

10. The system of claim 9, wherein:

said second coolant conduit is disposed in serial fluid communication between said first coolant conduit and said temperature responsive valve; and said temperature responsive valve is disposed in serial fluid communication between said second coolant conduit and said second drain.

11. The system of claim 10, wherein:

said pressure responsive valve is disposed in serial fluid communication between said first coolant conduit and said first drain.

12. The system of claim 11, further comprising:

a pump connected to said first coolant conduit for causing said coolant to flow through said first coolant conduit.

13. The system of claim 12, wherein:

said first coolant conduit is disposed in serial fluid communication between said pump and said second coolant conduit.

14. The system of claim 13, wherein:

said engine is an internal combustion engine.

15. The system of claim 14, wherein:

said engine provides power for an outboard motor.

16. A cooling system for an engine, comprising:

a cylinder formed in a cylinder block;

a piston disposed within said cylinder for reciprocating movement therein;

a cylinder head attached to said cylinder block, said piston, said cylinder and said cylinder head defining a chamber in which combustion occurs during operation of said engine, said combustion generating heat;

a first coolant conduit disposed within and in thermal communication with said cylinder block;

a first drain connected in serial fluid communication with said first coolant conduit;

a second coolant conduit disposed within and in thermal communication with said cylinder head, said first and second coolant conduits are disposed in serial fluid communication with each other;

a second drain connected in serial fluid communication with said second coolant conduit, said first and second drains being disposed in parallel association with each other;

a pressure responsive valve disposed in fluid communication with said first coolant conduit and said first drain; and a temperature responsive valve disposed in fluid communication with said second coolant conduit and said second drain, said temperature responsive valve controlling the rate of flow of a coolant through said second coolant conduit, said pressure responsive valve controlling the rate of flow of said coolant through said first drain and through said second coolant conduit, said pressure responsive valve causing generally all of the flow of said coolant passing through said first coolant conduit to flow through said second coolant conduit when said coolant is at a pressure less than a preselected threshold magnitude when said temperature sensitive valve permits such flow, said pressure responsive valve causing a portion of said coolant to flow through said first drain when said coolant is at a pressure greater than said preselected threshold, said second coolant conduit being disposed in serial fluid communication between said first coolant conduit and said temperature responsive valve, said temperature responsive valve being disposed in serial fluid communication between said second coolant conduit and said second drain.

17. The system of claim 16, wherein:

said pressure responsive valve is disposed in serial fluid communication between said first coolant conduit and said first drain.

18. The system of claim 17, further comprising:

a pump connected to said first coolant conduit for causing said coolant to flow through said first coolant conduit.

19. The system of claim 18, wherein:

said first coolant conduit is disposed in serial fluid communication between said pump and said second coolant conduit.

20. The system of claim 19, wherein:

said engine is an internal combustion engine and provides power for an outboard motor.

* * * * *